US005692858A

United States Patent [19]

Vaughan

[11] Patent Number: 5,692,858

[45] Date of Patent: Dec. 2, 1997

[54] APPARATUS FOR SOIL IRRIGATION

[76] Inventor: Donald R. Vaughan, 12 Third St., Woodland, Calif. 95695

[21] Appl. No.: 583,286

[22] Filed: Jan. 5, 1996

[51] Int. Cl.[6] ..... E02B 13/00

[52] U.S. Cl. ..... 405/43; 239/542; 405/36; 405/45

[58] Field of Search ..... 405/43, 45, 36, 405/46; 285/162; 239/542

[56] References Cited

U.S. PATENT DOCUMENTS

| | | | |
|---|---|---|---|
| Re. 18,969 | 10/1933 | Foulds | 103/11 |
| 444,564 | 1/1891 | Copeland | 405/43 X |
| 986,003 | 3/1911 | Von Hohenstein | 405/43 X |
| 1,015,401 | 1/1912 | Robison | 405/43 |
| 3,361,363 | 1/1968 | Babington | 405/43 X |
| 3,587,627 | 6/1971 | Gilmore | 137/445 |
| 3,779,468 | 12/1973 | Spencer | 405/43 X |
| 3,876,146 | 4/1975 | Pacheco | 239/145 |
| 4,293,237 | 10/1981 | Robey et al. | 405/43 X |
| 4,317,539 | 3/1982 | Pollock | 239/1 |
| 4,815,494 | 3/1989 | Raikamo | 137/593 |
| 5,141,360 | 8/1992 | Zeman | 506/43 |
| 5,204,499 | 4/1993 | Favalora | 285/162 X |
| 5,207,461 | 5/1993 | Lasko | 285/162 X |
| 5,353,445 | 10/1994 | Denzin | 285/162 X |

*Primary Examiner*—Dennis L. Taylor
*Attorney, Agent, or Firm*—Julian Caplan; Flehhr Hohbach Test Albritton & Herbert LLP

[57] ABSTRACT

A drip irrigation system employs a low-pressure head of about 1½ to 2 psi preferably by storage of water in a tank providing a column head of about 54 in. Header pipes extending into the field from the column are formed with holes at intervals. For each hole there is a flexible fitting having an end which fits into the header hole with a water-tight fit and has a short nipple at its opposite end. Then plastic tubing (e.g. about 0.001 to 0.002 thick high density polyethylene of approximately 1¼ inch diameter when expanded and formed with holes of about 0.001 to 0.00025 inch diameter at about 24 to 28 holes per foot) is taped to the nipple.

18 Claims, 2 Drawing Sheets

APPARATUS FOR SOIL IRRIGATION

CROSS REFERENCE TO RELATED APPLICATIONS

BACKGROUND OF THE INVENTION

1. Field of the Invention

This invention relates to a new and improved method and apparatus and a fitting for soil irrigation. More particularly the invention relates to a preferably underground drip irrigation system which operates under a low pressure head permitting pipe and fitting connections which are easily and rapidly connected and disconnected.

2. Prior Art

Drip irrigation systems have been used for many years. Such systems, however, have used tape or tubing having many disadvantages as compared with the present invention as hereinafter appear.

SUMMARY OF THE INVENTION

Water is supplied to the system through a standpipe which may lead from an overhead tank or other convenient source. A feature of the invention is that the pressure at the bottom of the standpipe may be very low, in the neighborhood of 1½ to 2 psi, which results from a head of approximately 54 inches. However, the structure herein described is capable of operating without leakage or rupture at much higher pressure—e.g. 90 psi. One or more headers extend horizontally from the bottom of the standpipe. Fittings comprising a seal and a nipple are installed at holes formed in the header where required. Each fitting is a flexible member of urethane or rubber which fits over a reduced diameter portion of the nipple and snaps into the hole in the header, forming a seal which is sufficient in view of the low pressure in the header. Tubing is attached to the outer end of the nipple. Again, because of the low pressure, tape or other convenient means may be used to fasten the tubing. The tubing preferably is thin-walled and formed at intervals with small holes. Under pressure, the tubing expands and water is delivered to the roots of plants in a manner simulating capillary attraction. No flow restrictors are required for even, slow deliver of water. When the water is turned off, the tubing collapses to a half-round shape. Therefore, water does not remain in the tubing and propagation of slime and algae and attraction of insects and rodents is eliminated. Further, wet spots where one portion of the tubing is lower than others are also eliminated.

Accordingly the present invention provides a method which transports and distributes water in a manner similar to natural methods whereby water is applied to soil. Water distribution is controlled without external pressure, and a predetermined bulk quantity of water is evenly distributed in a given area. Moisture is distributed radially from each of the plurality of fine holes in the tubing in an even, linear arrangement. A uniform amount of moisture is applied to a mass area with only natural attraction of gravity and capillary attraction. A uniform level of moisture is achieved in a designated area along a ribbon-like deposit in the soil.

A particular advantage of the invention is that no liquid remains in the tubing when irrigation has been discontinued.

Further, an even volume of water is released to increase the penetration thereof by capillary attraction and by the force of gravity.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
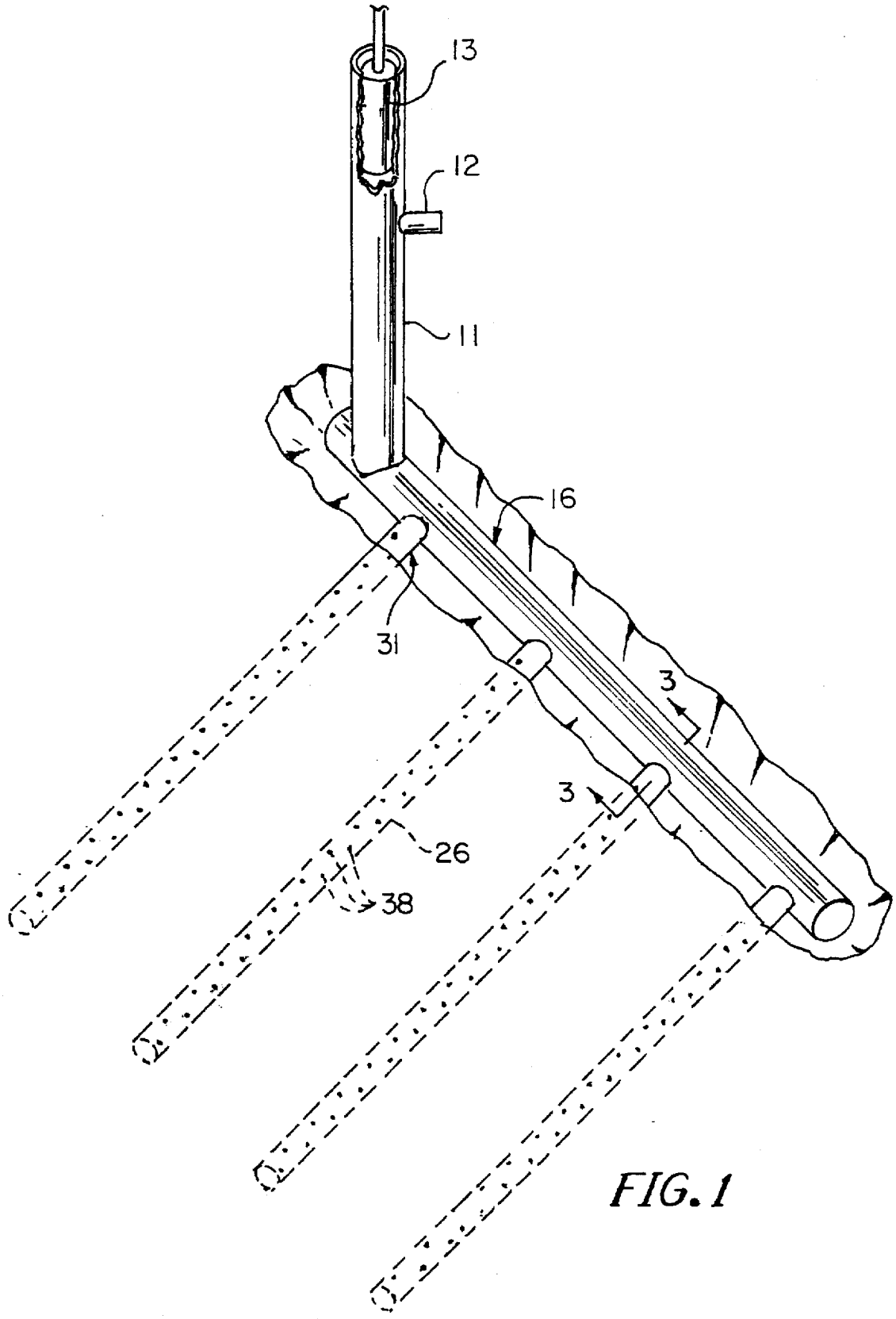
FIG. 1 is a schematic perspective view showing the invention installed in a field.
Figure 2:
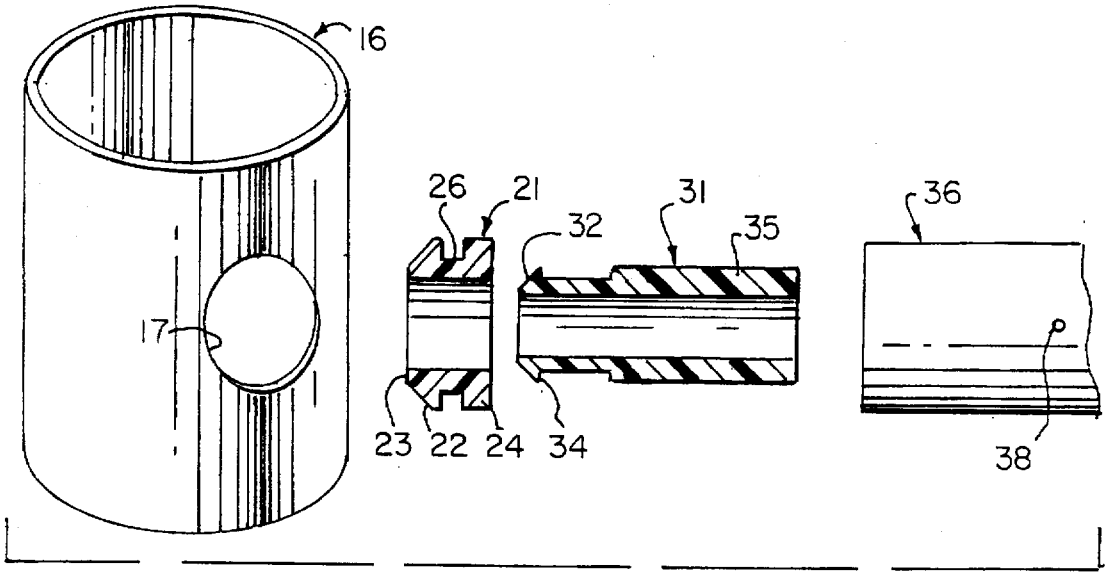
FIG. 2 is an exploded perspective view showing a portion of a header pipe and tubing and of the fitting therebetween.

As shown in FIG. 1, water is distributed throughout the system at low pressure. In the form shown there is a standpipe 11 receiving water through inlet 12. The level of water may be controlled by a float 13 in the standpipe which is connected by means not illustrated to a valve (not shown) in line 12. It will be understood that many other means may be used to supply and maintain a head of water in standpipe 11 which is preferably about 54 inches in height so that the pressure at the bottom of the standpipe is approximately 1½ to 2 inches psi. As previously stated, much higher pressures (e.g., 90 psi) may be used. Although only one header 16 is shown connected at the bottom of the standpipe 11, it will be understood that, depending upon the area to be irrigated, any number of headers 16 may be employed. Depth below the surface depends upon the crop and other factors. About 4 to 10 inches is desirable. The invention may also be used above ground.

Header 16 is formed with holes 17 at desired intervals depending upon the spacing of rows of crops or other considerations. Holes 17 may be drilled into header 16 by various means, preferably the drilling operation being performed in the field.

A principal feature and advantage of the invention is the facility whereby plastic tubing 36 may be attached so that water in the header 16 flows out through the tubing 36. The present invention provides an easy means to assemble and disassemble fittings in the holes 17. As hereinafter appears, thin-walled, perforated tubing is associated with each hole 17 by means of a fitting 21. Assembly and disassembly of the fittings is rapid and easy and does not require skilled labor. Further, because of the low pressure of the system, means may be used to seal the fittings to the headers and to seal the tubing to the fittings which would not otherwise be acceptable. Thus pipe threadings, although they could be used with the present invention, are rendered unnecessary.

Figure 5:
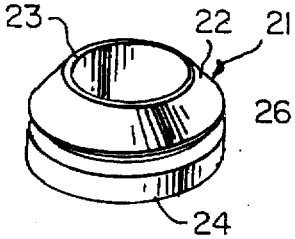
FIG. 5 is a perspective view of a seal used in the fitting.

In one preferred fitting shown in FIGS. 2–5, a seal 21 is provided formed of urethane or rubber or other suitable material of about 40 durometer. As shown in FIG. 5, fitting 21 has a tapered inner end 22 terminating in a truncated, flat edge 23. The outer end 24 is of enlarged diameter and there is a groove 26 intermediate ends 21 and 24 having an unstressed diameter slightly greater than a tangent across the walls of hole 17.

Nipple 31 has a tapered inner end 32 behind which is a reduced diameter portion 33 slightly longer than the length of seal 21 and having a diameter to fit tightly inside the seal 21. The outer end 35 may be somewhat elongated.

Seal 21 is inserted in hole 17 and retracted so that tapered area 22 contacts the inside of wall of header 16. Nipple 31 is pushed into seal 21 until the latter seats on reduced diameter portion 33 and truncated end 23 fits against shoulder 34. This provides a flexible connection so that the seal is maintained even if nipple 31 is out of alignment with header 16 or is slightly displaced by passage of agricultural equipment or natural causes.

Figure 4:
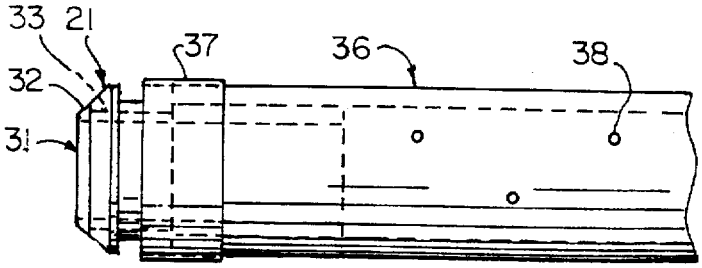
FIG. 4 is a side elevational view showing tubing attached to a portion of the fitting by tape.

Tubing 36 is preferably thin-walled and flexible. A satisfactory tubing is made of high density polyethylene having a wall thickness of about 0.001 to 0.002 inch initially packaged flat and, when filled with water, having a diameter of about 1¼ inches. Holes 38 are formed in the tubing of about 0.001 to 0.00025 inches in diameter with about 24 to 28 holes per foot. As shown in FIG. 4, an end of tubing 26 is slipped over the outer end 35 of fitting 31 and is attached thereto as by tape 37. Because of the low pressure of the system, simple means of attachment is satisfactory. It will be understood, of course, that other means of attachment may be employed.

One of the features of the tubing 36 is that in its initial use it expands to approximately a round cross section. When irrigation is discontinued, the tubing collapses to a half-round shape with a result that no moisture remains in the line. One of the disadvantages of other drip irrigation pipes is that moisture remains in the line promoting the growth of slime and algae and also attracting insects and rodents.

Another feature of the present invention is that even though one part of the tubing 36 is at a different elevation than another, dirt is not sucked into the tubing and hence the holes 38 are not clogged. Another advantage over open-type conventional drip irrigators is that flow restrictors need not be used with the present invention thereby considerably reducing the expense of the tubing 36. Still another feature of the invention is that even if some portions of the tubing 36 are at a lower elevation than others, wet spots do not form on the surface of the ground and promote mold which may damage crops.

Figure 3:
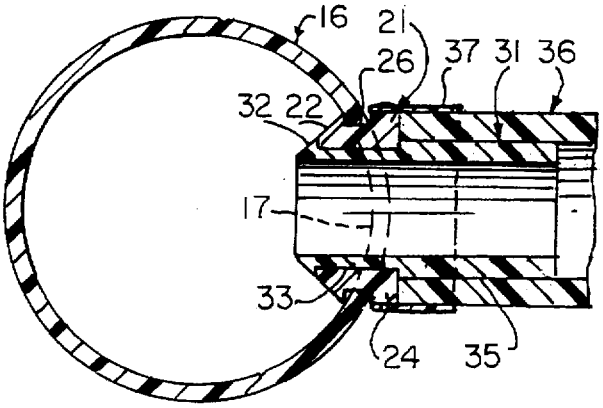
FIG. 3 is a sectional view taken substantially along the line 3—3 of FIG. 1.

Accordingly a means of employing the present invention is to form holes 38 in header 16, preferably by drilling the same at appropriate locations in the field. For each hole 38 a fitting consisting of nipple 31 and seal 21 is provided. The seal 21 is slipped over the inner end of nipple 21 as heretofore been described. Thereupon the inner end 32 is pushed through the hole 38, the seal 21 flexing and then snapping into position as best shown in FIG. 3 with the side walls of groove 26 engaging the inner and outer walls respectively of header 16.

Thereupon tubing 26 is attached to the nipple 31 as by means of tape 37 and the tubing 36 is stretched out in a trench preferably 4 to 10 inches below the surface and the trench is covered.

When water first is turned on, it flows through header 16 and out through hole 17 into the tubing 31 whence it is emitted through the minute holes 38 to spread by gravity and capillary action radially outwardly from each hole 38. When the water is turned off, tubing 36 collapses to a half-round shape, substantially all of the water previously in the tubing being discharged so that growth of algae and attraction of insects and rodents are eliminated.

When it is necessary to remove the tubing 36, it may be twisted, proceeding inwardly from its outer end so that it may be conveniently lifted out of the soil.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claims is:

1. A method for soil irrigation comprising disposing thin-walled plastic tubing in proximity to the soil surface, said tubing being elongated and flexible and initially flat and formed with a plurality of small holes spaced along the length of said tubing, flowing water into said tubing at low head whereby water is discharged through said holes and said tubing assumes a round cross section, discontinuing flowing water into said tubing, the upper half of said tubing collapsing into the lower half of said tubing, said tubing gradually assuming a half-round upwardly concave shape to substantially discharge all water from said tubing.

2. A method according to claim 1 in which water discharged through said holes spreads radially from said holes and is absorbed into the soil by gravity and capillary action.

3. A method according to claim 1 which further comprises preliminarily providing a header extending substantially horizontally formed with at least one aperture and connecting said tubing through one said aperture with a flexible fitting which fits partially into said aperture and seals against the walls of said header around said aperture and to said tubing.

4. A method according to claim 3 in which said fitting comprises a nipple smaller than said aperture and a substantially annular, flexible seal on the exterior of said nipple inserting an end of said fitting into said aperture and thereby flexing said seal to snap outwardly to engage an inner wall of said header surrounding said aperture to form a water-tight connection to said inner wall.

5. A method according to claim 3 in which said tubing fits over an end of said fitting outside said header and which further comprises sealing said tubing to said fitting.

6. Apparatus for irrigation comprising a header adapted to convey water from a source formed with at least one aperture of pre-selected size, said header having an inner wall and an outer wall;

a fitting comprising a nipple extending through said hole having a first end inside said header and a second end outside said header, a flexible seal around said nipple intermediate said ends having an inner end shaped to form a seal to said inner wall around the margin of said aperture and to form a seal to said outer wall around the margin of said aperture; and a thin walled plastic tube formed with a plurality of longitudinally spaced holes, said tube having an end engaging said second end of said nipple and means attaching said tube to said nipple.

7. Apparatus according to claim 6 in which said source comprises a substantially vertical pipe connected to said header and means for maintaining a pre-selected pressure head in said pipe.

8. Apparatus according to claim 7 in which said pressure head is about 1½ to 2 psi.

9. Apparatus according to claim 3 in which said pipe has an elevation of about 54 inch.

10. Apparatus according to claim 6 in which said nipple at said first end is formed with a shoulder against which said seal seats.

11. Apparatus according to claim 6 in which said seal is formed of a rubber-like, relatively soft material.

12. Apparatus according to claim 11 in which said seal is annular and formed intermediately said ends which a groove having a diameter slightly greater than that of said aperture.

13. Apparatus according to claim 12 in which said seal is formed with an inner end, having a maximum diameter greater than the diameter of said aperture.

14. Apparatus according to claim 13 in which said inner end is truncated and said nipple at said first end is formed with a shoulder against which said inner end seats.

15. Apparatus according to claim 6 in which said tubing has a wall thickness of about 0.001 to 0.002 inch and said holes are positioned about 24 to 28 per inch and said holes are about 0.00025 to 0.001 inch size.

16. A fitting for connecting tubing to a header having an aperture therein comprising a nipple having a shoulder at a first end thereof and a resilient, annular seal formed of a rubber-like material dimensioned to fit over said nipple and engage said shoulder, said seal being larger than said aperture and formed with a groove slightly larger than said aperture, said seal being dimensioned to fit through said aperture;

whereby said first end and said seal may be inserted through said aperture, said groove having an inner wall adapted to seal circumferentially against an inside wall of said header and an outer wall adapted to seal circumferentially against an outside wall of said header.

17. A fitting according to claim 16 in which said nipple is formed with a reduced diameter portion intermediate its ends, said seal engaging said reduced diameter portion.

18. A fitting according to claim 16 in which said seal has a conical first end.

* * * * *